US005849210A

United States Patent [19]

Pascente et al.

[11] Patent Number: 5,849,210

[45] Date of Patent: Dec. 15, 1998

[54] METHOD OF PREVENTING COMBUSTION BY APPLYING AN AQUEOUS SUPERABSORBENT POLYMER COMPOSITION

[76] Inventors: Joseph E. Pascente, 71 Regent Dr., Oak Brook, Ill. 60521; Thomas J. Pascente, 174 Island Ct., Schaumberg, Ill. 60194

[21] Appl. No.: 526,433

[22] Filed: Sep. 11, 1995

[51] Int. Cl.[6] ..... A62D 1/00

[52] U.S. Cl. ..... 252/3; 169/45; 169/46; 252/2; 252/605; 252/610

[58] Field of Search ..... 428/283; 252/2, 252/3, 605, 610; 169/45, 46

[56] References Cited

U.S. PATENT DOCUMENTS

| | | | |
|---|---|---|---|
| Re. 30,029 | 6/1979 | Smith | 128/285 |
| 3,407,138 | 10/1968 | Harper et al. | 252/2 |
| 3,637,409 | 1/1972 | Hartman | 117/7 |
| 3,865,782 | 2/1975 | Anderson | 260/45.9 R |
| 3,891,599 | 6/1975 | Marciniak et al. | 260/45.7 R |
| 3,926,891 | 12/1975 | Gross et al. | 260/29.6 E |
| 3,971,761 | 7/1976 | Anderson et al. | 260/45.9 KA |
| 3,980,663 | 9/1976 | Gross | 260/29.6 TA |
| 4,041,121 | 8/1977 | Smith | 264/191 |
| 4,057,521 | 11/1977 | Gross | 260/29.6 HN |
| 4,066,584 | 1/1978 | Allen et al. | 260/17.4 CL |
| 4,104,214 | 8/1978 | Meierhoefer | 260/17.4 CL |
| 4,454,055 | 6/1984 | Richman et al. | 252/194 |
| 4,816,539 | 3/1989 | Watanabe et al. | 526/320 |
| 4,900,377 | 2/1990 | Redford et al. | 156/62.2 |
| 4,962,172 | 10/1990 | Allen et al. | 526/318.42 |
| 4,997,714 | 3/1991 | Farrar et al. | 428/394 |
| 5,140,076 | 8/1992 | Hatsuda et al. | 525/375 |
| 5,147,956 | 9/1992 | Allen | 526/318.42 |
| 5,174,231 | 12/1992 | White | 112/420 |
| 5,230,959 | 7/1993 | Young, Sr. et al. | 428/372 |
| 5,280,079 | 1/1994 | Allen et al. | 525/329.2 |
| 5,284,703 | 2/1994 | Everhart et al. | 428/283 |
| 5,321,788 | 6/1994 | Arroyo et al. | 385/109 |
| 5,338,345 | 8/1994 | Scarborough et al. | 106/2 |
| 5,346,565 | 9/1994 | White | 156/71 |
| 5,346,566 | 9/1994 | White | 156/71 |
| 5,389,166 | 2/1995 | White | 156/71 |
| 5,397,626 | 3/1995 | Berg et al. | 428/283 |

FOREIGN PATENT DOCUMENTS

| | | |
|---|---|---|
| 2134130 | 4/1995 | Canada . |
| WO 94/02257 | 3/1994 | WIPO . |

OTHER PUBLICATIONS

Roscommon Equipment Center Program Project No. 41–B, "An Analysis of Foam, Long and Short Term Retardants," Northeast Forest Fire Supervisors (Apr. 1988, updated Sep. 1989), 29 pages.

Sales brochure for Barricade® Fire–Blocking Gel, attached OSHA Material Safety Data Sheet and computer printouts from search identifying components.

Advertising sheets for Fire Blaster™ fire suppression material.

*Primary Examiner*—James J. Bell

*Attorney, Agent, or Firm*—Marshall, O'Toole, Gerstein, Murray & Borun

[57] ABSTRACT

A method of preventing or retarding a combustible object from burning includes the steps of mixing water with a superabsorbent polymer ("SAP") to form one at least partially hydrated SAP, and applying the at least partially hydrated SAP to the combustible object, before or after combustion. In another embodiment, an article of manufacture includes a SAP, that is prehydrated, or hydrated at a later time, is useful for preventing a combustible object from burning, or for providing a human fire shield or preventing penetration of extreme heat or fire to a firefighter or other animal.

16 Claims, No Drawings

METHOD OF PREVENTING COMBUSTION BY APPLYING AN AQUEOUS SUPERABSORBENT POLYMER COMPOSITION

FIELD OF THE INVENTION

This invention relates to a method of preventing a combustible object from burning and to a method of extinguishing a burning object by applying an insulating, superabsorbent polymer material to the combustible object. The invention also relates to articles of manufacture useful for preventing a combustible object from burning, and for insulating a person or object from increased temperature.

BACKGROUND OF THE INVENTION AND PRIOR ART

Water is often used to extinguish fires or to prevent combustible objects from burning. Water can reduce the temperature of combustible material until the material is at too low of a temperature to burn. When a fire is extinguished by spraying water on the fire, only less than about 8% of the water is generally effective in extinguishing the fire, due to loss of water, such as by run-off or evaporation of the water.

Water-absorbing resins or superabsorbent polymers ("SAP"), are polymeric materials that are insoluble in water but can absorb at least ten times, preferably at least 20 times their weight in tap water, and have not been used previously in fighting fires, but have been used widely in sanitary goods, hygienic goods, wiping cloths, water retaining agents, dehydrating agents, sludge coagulants, disposable litter mats for pets, condensation preventing agents, and release control agents for various chemicals.

The present invention is directed to a method of using SAP to smother fires or prevent combustible objects from burning by coating combustible objects with a composition of a superabsorbent polymer and water, preferably a gel formed from SAP and water. In accordance with another embodiment, articles of manufacture that include SAP can be hydrated during use for preventing combustible objects from burning, and for insulating a person or object from increased temperature.

SUMMARY OF THE INVENTION

In brief, the present invention is directed to a method of preventing a combustible object from burning, or reducing the extent of burning of a combustible object, by contacting the combustible object, before or during burning, with an aqueous composition comprising a water-insoluble superabsorbent polymer and water. Water can be added to the superabsorbent polymer after contacting the combustible object with neat superabsorbent polymer (100% SAP application, with later addition of water to hydrate the SAP), or more preferably, the superabsorbent polymer is premixed with water in a SAP concentration of about 0.001% SAP to about 50% by weight SAP, preferably about 0.01% SAP to about 10% by weight SAP, more preferably about 0.1% SAP to about 1.0% SAP. When applied wet, particularly to surfaces having a vertical component, e.g., vertical walls, the surface can be pre-coated with an adhesive, e.g., a water soluble adhesive, such as an aqueous solution of guar gum in an amount sufficient to adhere the SAP in position on the surface of the object to be protected prior to hydration of the SAP with water.

Additionally, the present invention is directed to a method of preventing a combustible object from burning by spraying an aqueous SAP composition onto a combustible object, prior to combustion of said combustible object, e.g., from a hand-held fire extinguisher, or by admixing powdered or granular SAP with a flowing stream of water. Further, the present invention is directed to a method of extinguishing at least a portion of a fire by spraying a burning object with the aqueous SAP composition in an amount sufficient to continuously or discontinuously coat the burning object with the aqueous SAP composition to sufficiently cool the burning object, or in an amount sufficient to reduce the quantity of oxygen from the surface of the burning object to a degree such that the flame is extinguished. Additionally, the present invention is directed to flame retardant articles that can be manufactured to include dry SAP and can be wetted on demand to form a flame shield or flame retardant blanket or garment to protect fire fighters and others in a burning building.

Therefore, an object of the invention is to overcome one or more of the problems described above.

According to the invention, a method of preventing a combustible object from burning includes the steps of providing a firefighting or fire-preventive composition comprising a mixture of water and a superabsorbent polymer ("SAP"), preferably in the form of a gel, and applying the firefighting gel to the combustible object prior to or during pyrolysis thereof.

The invention also is directed to an article of manufacture including a continuous or discontinuous layer of SAP that is useful for preventing a combustible object from burning.

Other objects and advantages of the invention will be apparent to those skilled in the art from the following detailed description, taken in conjunction with the appended claims.

DETAILED DESCRIPTION OF THE INVENTION

According the invention, a method of fighting, extinguishing or slowing the progression of fires or preventing combustible objects from burning includes the steps of admixing water with a SAP to form a firefighting composition, preferably a gel, and applying the firefighting composition to a fire or to a combustible object.

An SAP is a water-insoluble polymeric material that can absorb at least 10 times its weight in water. Preferably, the SAP can absorb at least 20 times its weight in water. More preferably, the SAP can absorb at least 50 times its weight in water. Most preferably, the SAP can absorb at least 100 times it weight in water.

Water-insoluble absorbent polymeric materials useful for the present invention are well known in the art and are at least partially cross-linked to render the polymers water-insoluble. For example, Berg et al., U.S. Pat. No. 5,397,626, describes suitable cross-linked polymeric materials (see column 6, line 47 to column 8, line 53), and its disclosure is incorporated herein by reference.

As disclosed by Berg et al., SAPs include cross-linked polymers prepared from polymerizable, unsaturated, acid-containing monomers, including olefinically unsaturated acids and anhydrides that contain at least one carbon to carbon olefinic double bond. More specifically, these monomers include olefinically unsaturated carboxylic acids and acid anhydrides, olefinically unsaturated sulfonic acids, and mixtures thereof.

Some non-acid monomers may also be used to prepare the SAP, such as the water-soluble or water-dispersible esters of the acid-containing monomers as well as monomers that contain no carboxyl or sulfonic acid groups at all. For example, the monomers may contain functional groups such as carboxylic acid or sulfonic acid esters, hydroxyl groups, amide groups, amino groups, nitrile groups, and quaternary ammonium salt groups.

Olefinically unsaturated carboxylic acid and carboxylic acid anhydride monomers include the acrylic acids such as acrylic acid, methacrylic acid, ethacrylic acid, and alpha-chloroacrylic acid. Olefinically unsaturated sulfonic acid monomers include aliphatic or aromatic vinyl sulfonic acids such as vinyl sulfonic acid, allyl sulfonic acid, and vinyl-toluene sulfonic acid.

Preferred superabsorbent polymer materials for use in the present invention include a carboxyl group. Examples of these polymers include hydrolyzed starch-acrylonitrile graft copolymers, partially neutralized starch-acrylonitrile graft copolymers, starch-acrylic acid graft copolymers, partially neutralized starch-acrylic acid graft copolymers, saponified vinyl acetate-acrylic ester copolymers, hydrolyzed acrylonitrile or acrylamide copolymers, partially crosslinked products of any of the foregoing copolymers, partially or completely neutralized polyacrylic acid, and partially crosslinked products of partially neutralized polyacrylic acid. These polymers may be used independently or in the form of copolymers formed from a mixture of two or more of such monomers.

Most preferred superabsorbent polymer materials are crosslinked products of partially neutralized polyacrylic acids and starch derivatives therefrom. Most preferably, the solid SAP particles comprise from about 50% to about 95%, preferably about 75% neutralized crosslinked polyacrylic acid, e.g., poly (sodium acrylate/acrylic acid).

As described above, the polymer materials are crosslinked to an extent such that the polymer is water-insoluble. The crosslinking serves to render the polymers substantially water-insoluble and in part serves to determine the absorptive capacity of the polymers. Suitable cross-linking agents are known in the art and include the di- or poly-functional molecules capable of cross-linking polyacrylic acid and/or metal salts of polyacrylic acid by reaction with the acrylic or acrylate functional groups of the polymer. Such cross-linking agents include diglycidyl ethers, dialcohols, and diamines. Preferably, the cross-linking agent should be water-soluble and possess reactivity with the polymer such that cross-linking occurs in a controlled fashion in the temperature range of about 50° C. to about 150° C. Suitable cross-lining agents include ethylene glycol, polyethylene glycols, polypropylene glycols, and diglycidyl ethers of (poly) ethylene glycols. Of particular preference is ethylene glycol diglycidyl ether (EGDGE), a water-soluble diglycidyl ether. Additional cross-linking agents are disclosed in EPO 450 923 A2 (Nippon Shokubai Kagaku Kogyo Co.).

To form a firefighting composition, preferably a gel, useful in preventing combustible objects from burning, or reducing the combustibility of a combustible material, a small amount of SAP is mixed with water. The composition preferably contains from about 0.001% to about 50% SAP, more preferably about 0.01% to about 10% SAP, and most preferably about 0.1% to about 1% by weight SAP. The firefighting composition is effective because it immobilizes water where it is needed, and excludes the presence of oxygen at the surface of a combustible object. The composition functions by forming a relatively gas-impermeable barrier on the surface of combustible objects, which prevents oxygen from reaching, or substantially lessens the amount of oxygen that supports combustion of, the combustible objects and thus prevents combustion from occurring or continuing, or substantially increases the time required for combustion of objects. In addition, the aqueous SAP composition forms a thermal barrier that slows the transfer of heat from a fire to a combustible object.

The firefighting composition may be used in numerous ways to fight, prevent or slow fires. The aqueous composition may be formed in advance, by mixing SAP and water, and stored in tanks such as pressurized fire extinguishers or fire truck storage tanks. The composition can then be sprayed onto a burning object to smother the fire. Because the SAP is deformable, the gel can be extruded through a small opening, such as the nozzle of a fire extinguisher. When applied through a restricted opening, as in a fire extinguisher, it is preferred that the SAP particles have a particle size less than about 100 um in diameter, more preferably less than about 100 um in diameter. The gel adheres to vertical surfaces, such as the walls of a burning building and, therefore remains in place as an insulator to prevent fire from reaching or combusting vertical walls.

The firefighting composition may also be formed just prior to use, by adding dry SAP to a stream of water. The aqueous composition may be used by applying it to objects that are already burning or by applying it to objects that are not burning but are in danger of igniting, such as a building or other structure near a burning building. In this way the aqueous composition can be used both to extinguish fires and to prevent fires from spreading.

After prolonged exposure to heat, the gel slowly loses water and becomes less effective at preventing combustion. Eventually the gel will burn. For example, sodium polyacrylate SAP, when pyrolyzed, produces carbon dioxide and sodium carbonate.

The aqueous composition may also be applied in the form of a foam. Foamed compositions of SAP and water are particularly effective for smothering flaming grease fires and burning organic liquids since without the foaming agent, the organic liquids, e.g., solvents, may migrate through a non-foamed composition of superabsorbent polymer and water. The foamed compositions completely block oxygen from reaching a flaming organic liquid for completely extinguishing the fire. Foaming agents, such as carbon dioxide, may be added to the aqueous SAP composition to form the firefighting foam. The foam is applied to combustible objects and used to fight fires in a manner similar to the non-foamed firefighting aqueous composition, as described above. Other additives may also be included in the firefighting composition. Other fire retardant chemicals may be included but preferably the firefighting gel does not include another fire retardant chemical.

As noted above, the aqueous firefighting composition may be useful in preventing fires from spreading, as well as in extinguishing fires. More specifically, the composition may be used to form a firebreak or firewall that prevents a fire from spreading. In attempting to contain large fires, such as forest fires, firefighters sometimes try to prevent the fire from spreading by removing combustible materials. In fighting forest fires, for example, firefighters may clear a band of trees along a continuous path spaced from the fire to form a firebreak, which prevents the fire from spreading to other trees and combustible objects on a non-burning side of the cleared path. The SAP of the present invention may be used to prevent a forest fire from spreading without clearing unburned trees from the area. Dry or hydrated SAP may be applied to a band of trees rather than removing the trees to form a fire barrier. If applied dry, water then is applied to the SAP to form an aqueous composition from a relatively small amount of the SAP. As the layer of hydrated SAP becomes dried out or burned away, additional water can be added to form another layer of gel. By applying a large quantity of SAP to the surface of the trees and by adding additional water as needed, a fire-insulating gel layer can be maintained on the trees for a long period of time. A similar procedure may be employed to prevent a fire from spreading to buildings or to other combustible objects.

In an alternative embodiment, the SAP may be included in a fire-retardant article of manufacture, such as a fire blanket, which is useful for covering an object to prevent it from burning. The fire-retardant article may be a single fabric layer that is manufactured from SAP fibers, and/or from other fibers with SAP articles secured between or among the fibers, such as disclosed in this Assignee's U.S. Pat. No. 5,389,166, hereby incorporated by reference, that incorporates bentonite clay particles. By substituting SAP particles for the clay particles disclosed in U.S. Pat. No. 5,389,166, a fire retardant fabric can be manufactured that can be wetted when a fire approaches a person. Alternatively, the fire-retardant article may be a multi-layer article of manufacture including two sheets or fabric layers, preferably formed from fire-retardant fibers, with a layer of SAP therebetween as disclosed (incorporating clay instead of SAP) in this Assignee's U.S. Pat. No. 5,346,565, hereby incorporated by reference; or the article may be formed into a fire retardant woven or non-woven fabric or a sheet from films or fibers formed of SAP, e.g., see U.S. Pat. Nos. 3,926,891; 3,980,663; 4,104,214; 4,066,584; 4,057,521; 4,041,121; 4,454,055; 4,861,539; 4,997,714; 4,962,172; 5,147,956; 5,280,079; and RE 30,029, all of which are hereby incorporated by reference. Two fabric layers may be structurally interconnected to surround the intermediate SAP layer, such as by needle punching or sewing or quilting at spaced locations over essentially the entire surface areas of both sheet or fabric material layers. Methods of manufacturing multilayer articles including an intermediate layer of a water-swellable bentonite clay material also are disclosed in White, U.S. Pat. No. 5,174,231, which is incorporated herein by reference. Substitution of SAP for the clay disclosed in U.S. Pat. No. 5,174,231, with or without the use of a needle lubricant during manufacture, provides a multilayer article having a layer of SAP between fabric layers.

To use the fire-retardant article, water is applied to the article and absorbed by the SAP particles, forming a continuous layer of firefighting composition. The fire-retardant article, such as a fire blanket, may be placed on a combustible object first, and then wetted to form a fire-resistant barrier, or, alternatively, the article may be wetted first and then placed on a combustible object.

The fire-retardant article may also be used as a protective garment. The article is of relatively light weight until water is applied to form an aqueous firefighting composition, preferably a gel layer. The fire-retardant article should contain about 5% to 100% SAP, based on the dry weight of the article, preferably about 25% to 100% SAP. The protective garment may be worn by a firefighter, for example. If the firefighter needs additional protection from a fire, such as if a fire unexpectedly expands or moves and threatens the safety of the firefighter, then the firefighter can simply apply water to the garment to produce an additional layer of protection from the fire. This may allow a firefighter to stay in a burning building covered by the wetted fire blanket, while breathing through an oxygen tank, for an additional period of time, or protect the firefighter by covering at least 20% of his surface area, such as his head and torso, to allow him to exit a burning structure without being injured by the fire.

EXPERIMENTAL

A SAP/water gel was formed by mixing together 157 grams of water and 3 grams SAP (75% neutralized polyacrylic acid, sodium polyacrylate, and 25% free acrylic acid). One-half quart of the gel was spread onto 25 red hot charcoals to completely cover the upper surface of all charcoals. After about 2 minutes, the upper surfaces of the charcoals were cool enough to touch with a hand. By lowering the SAP/water weight ratio to about 1–2 grams SAP/150 grams water or about 0.05% to about 1.5% by weight SAP in the SAP/water mixture, the composition will flow more easily to completely coat and extinguish all surfaces of a burning material. Higher viscosity gels can be adhesively secured to vertical or sloped surfaces to hold the gel in place.

The foregoing detailed description is given for clearness of understanding only, and no unnecessary limitations should be understood therefrom, as modifications within the scope of the invention will be apparent to those skilled in the art.

What is claimed is:

1. A method of retarding a combustible object from burning comprising the steps of:

(a) providing an aqueous firefighting composition comprising a mixture of water and a superabsorbent polymer that absorbs at least 20 times its weight in water;

(b) applying the firefighting composition to an exposed surface of the combustible object.

2. The method of claim 1, wherein the firefighting composition comprises about 0.001% to 50% by weight superabsorbent polymer and water.

3. The method of claim 2, wherein the firefighting composition comprises from about 0.01% to about 1% by weight superabsorbent polymer and from about 99% to about 99.99% by weight water.

4. The method of claim 1, wherein the superabsorbent polymer comprises a cross-linked, water-insoluble acrylate polymer.

5. The method of claim 1, wherein the superabsorbent polymer comprises a polymer of an acrylic acid monomer.

6. The method of claim 1, wherein the superabsorbent polymer is selected from the group consisting of: a cross-linked polyacrylic acid; a cross-linked, partially neutralized polyacrylic acid; a cross-linked, fully neutralized polyacrylic acid; and mixtures thereof.

7. The method of claim 6, wherein the superabsorbent polymer comprises a polymerized, partially neutralized acrylic acid.

8. The method of claim 1, wherein the superabsorbent polymer comprise a sodium polyacrylate, neutralized about 75 mole %.

9. The method of claim 1, wherein the firefighting composition is stored in a pressurized tank before use.

10. The method of claim 1, wherein the firefighting composition is prepared by adding dry superabsorbent polymer to a flowing stream of water.

11. The method of claim 1, wherein the firefighting composition is prepared by applying superabsorbent polymer to a combustible object and then adding water to the superabsorbent polymer on said combustible object.

12. A method of protecting a person or object from increased temperature comprising applying a heat-resistance article of manufacture on an exposed surface of the person or object, said article of manufacture comprising a flexible fabric layer containing a superabsorbent polymer that absorbs at least 20 times its weight in water, said superabsorbent polymer comprising about 5% to 100% by weight of said dry article of manufacture, said superabsorbent polymer being at least partially hydrated with water.

13. The method of claim 12, wherein the article protects a person from increased temperature and is applied over at least 20% of a surface area of the person, said article containing about 25% to 100% superabsorbent polymer, by weight, based on the dry weight of the article.

14. The method of claim 12, wherein the article includes superabsorbent polymer fibers.

15. The method of claim 12, wherein the article is formed from superabsorbent polymer fibers.

16. The method of claim 12, wherein the superabsorbent polymer comprises a cross-linked, water-insoluble polymer capable of absorbing at least about 50 times its weight in water.

* * * * *

US005849210C1

(12) EX PARTE REEXAMINATION CERTIFICATE (5552nd)

United States Patent

Pascente et al.

(10) Number: US 5,849,210 C1

(45) Certificate Issued: Oct. 10, 2006

(54) METHOD OF PREVENTING COMBUSTION BY APPLYING AN AQUEOUS SUPERABSORBENT POLYMER COMPOSITION

(75) Inventors: Joseph E. Pascente, Oak Brook, IL (US); Thomas J. Pascente, Schaumberg, IL (US)

(73) Assignee: Almata, Inc., Downers Grove, IL (US)

Reexamination Request:
No. 90/007,622, Jul. 12, 2005

Reexamination Certificate for:

| | |
|---|---|
| Patent No.: | **5,849,210** |
| Issued: | **Dec. 15, 1998** |
| Appl. No.: | **08/526,433** |
| Filed: | **Sep. 11, 1995** |

(51) Int. Cl.
*A62D 1/00* (2006.01)

(52) U.S. Cl. ..... 252/3; 252/2; 252/605; 252/610; 169/45; 169/46

(58) Field of Classification Search ..... 428/283; 252/2, 605; 169/45, 46
See application file for complete search history.

(56) References Cited

U.S. PATENT DOCUMENTS 3,229,769 A * 1/1966 Bashaw et al. ..... 169/45
3,976,580 A * 8/1976 Kaminstein et al. ..... 252/2
4,076,663 A * 2/1978 Masuda et al. ..... 525/54.31
4,286,082 A * 8/1981 Tsubakimoto et al. ..... 526/240
RE32,649 E * 4/1988 Brandt et al. ..... 604/368
5,087,513 A * 2/1992 Kim ..... 442/118
5,145,906 A * 9/1992 Chambers et al. ..... 524/732
5,230,959 A * 7/1993 Young et al. ..... 428/372

OTHER PUBLICATIONS

Studies in Polymer Science 8, Absorbent Polymer Technology, pp. 13 & 14, published in 1990.*
"Recent Advances in Superabsorbent Polyacrylates", Fredric L. Buchholz, Trends in Polymer Science, vol. 2. No. 8 (Aug. 1994), pp. 277 and 280.*
Modern Superabsorbent Technology, pp. 19, 74–77, 114 and 115, published Dec. 1997.*

* cited by examiner

*Primary Examiner*—Bennett Celsa

(57) ABSTRACT

A method of preventing or retarding a combustible object from burning includes the steps of mixing water with a superabsorbent polymer ("SAP") to form one at least partially hydrated SAP, and applying the at least partially hydrated SAP to the combustible object, before or after combustion. In another embodiment, an article of manufacture includes a SAP, that is prehydrated, or hydrated at a later time, is useful for preventing a combustible object from burning, or for providing a human fire shield or preventing penetration or extreme heat or fire to a firefighter or other animal.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–16 are cancelled.

* * * * *